US005318324A

United States Patent [19]

Lombardo et al.

[11] Patent Number: 5,318,324

[45] Date of Patent: Jun. 7, 1994

[54] PRESSURE SEAL-ECCENTRIC Z-FOLD LIBRARY ENVELOPE

[75] Inventors: Leo Lombardo; Brian Goodno, both of Manchester, N.H.

[73] Assignee: Moore Business Forms, Inc., Grand Island, N.Y.

[21] Appl. No.: 986,736

[22] Filed: Dec. 8, 1992

[51] Int. Cl.[5] ..... B42D 15/00

[52] U.S. Cl. ..... 283/62; 229/70; 156/250

[58] Field of Search ..... 283/62, 55, 116, 2; 281/2, 45; 229/68 R, 72, 92.8, 70; 156/250, 251, 256, 260

[56] References Cited

U.S. PATENT DOCUMENTS

| | | | |
|---|---|---|---|
| 1,413,123 | 4/1922 | Kearney | 283/116 X |
| 3,467,299 | 9/1969 | Meyer | 229/72 |
| 3,655,119 | 4/1972 | Thompson | 229/72 |
| 3,718,276 | 2/1973 | Vandergrift et al. | 229/72 |
| 4,543,082 | 9/1985 | Stenner | 493/216 |
| 4,619,399 | 10/1986 | Szmuk et al. | 229/72 |
| 4,730,767 | 3/1988 | Gendron | 229/73 |
| 4,915,287 | 4/1990 | Volk et al. | 229/70 |
| 4,948,034 | 8/1990 | Rohloff | 283/2 X |
| 5,082,168 | 1/1992 | Gaetano | 229/72 |
| 5,141,252 | 8/1992 | Michlin | 281/15.1 |
| 5,193,850 | 3/1993 | Lombardo | 281/5 X |

*Primary Examiner*—Mark Rosenbaum
*Assistant Examiner*—Willmon Fridie, Jr.
*Attorney, Agent, or Firm*—Nixon & Vanderhye

[57] ABSTRACT

A pocket containing business form is formed from an intermediate which comprises a sheet of paperlike material having dimensions of about 8×11 inches. The sheet is guillotine cut in two lengthwise, and each of the sections is eccentrically Z-folded to form a pocket, with pressure activated adhesive strips sealed along the edges of the pocket. The portion of the sheet exposed above the pocket is imaged by a laser printer, etc., for example, to indicate due dates for library books. The form is glued on one of the inside covers of a library book, and a 3×5 card containing information about the book is inserted in the pocket.

23 Claims, 1 Drawing Sheet

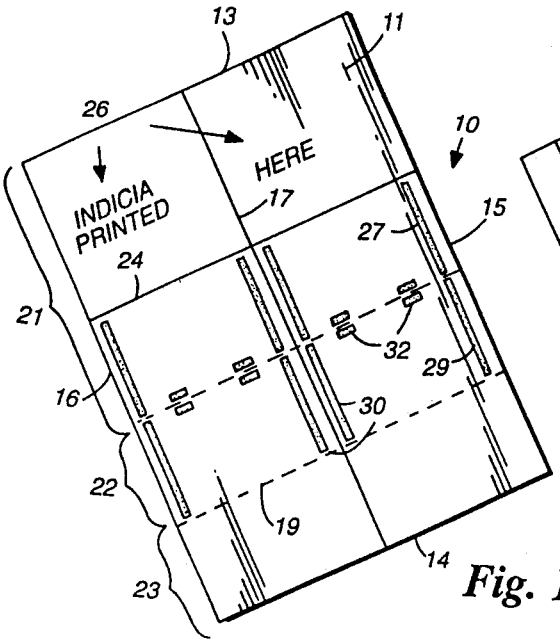
Fig. 1
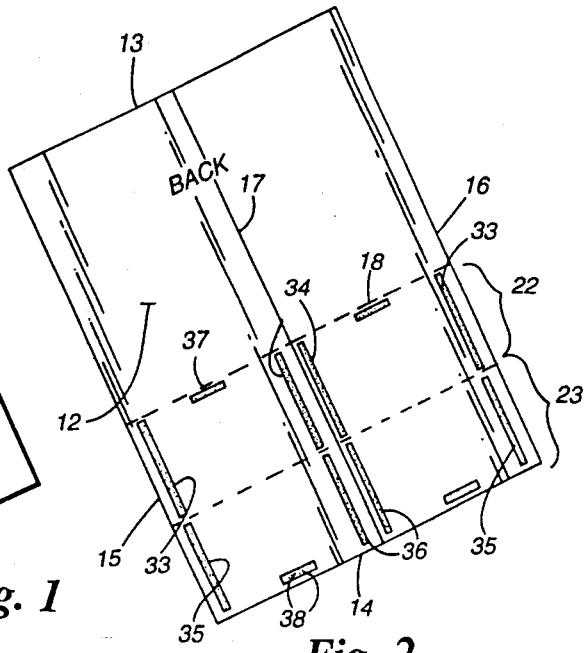
Fig. 2
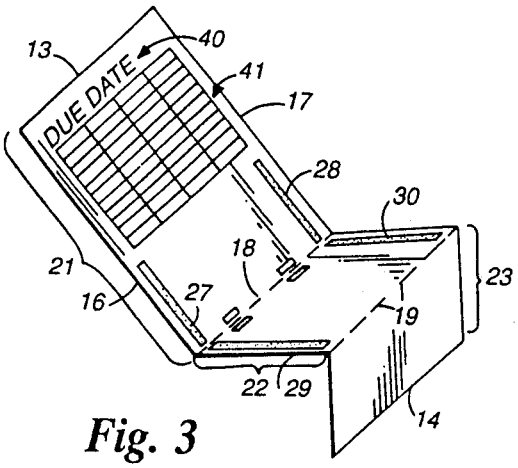
Fig. 3
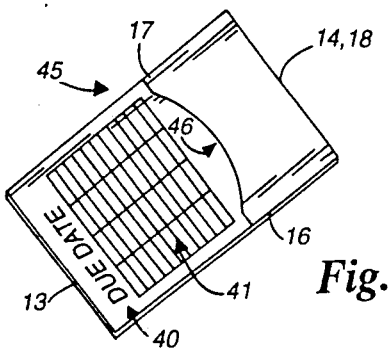
Fig. 4
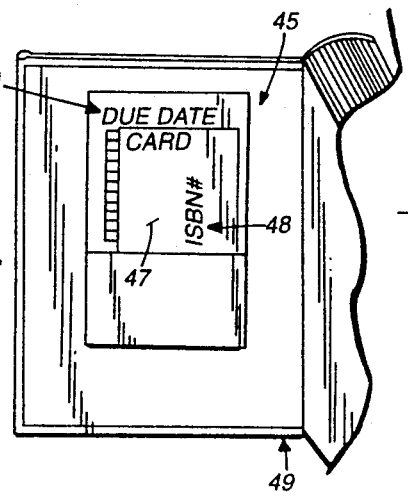
Fig. 5
Fig. 6
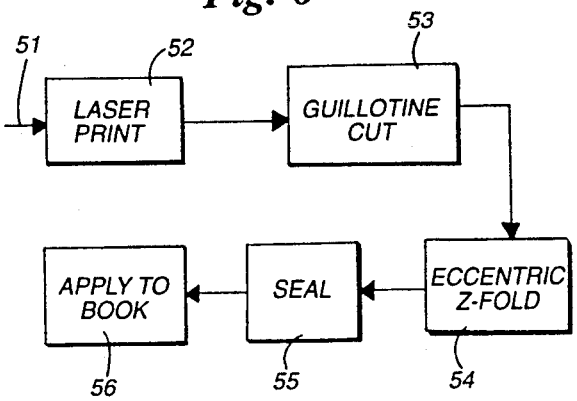

PRESSURE SEAL-ECCENTRIC Z-FOLD LIBRARY ENVELOPE

BACKGROUND AND SUMMARY OF THE INVENTION

In the construction of pocket forming elements which are fastened inside library books to hold a 3×5 card, and to indicate the due date for the library book, etc., typically it is necessary to purchase an envelope and a separate information card. The separate information card is preprinted and stapled or otherwise affixed to the open top envelope. This requires purchase of different components, assembly time, and is not conveniently practiced using on site conventional printers, such as laser printers.

According to the present invention, a method and business form, as well as an intermediate for construction of the business form, are provided which provide a much simpler procedure and structure than in the prior art, yet the product produced according to the invention is just as functional, although likely less expensive. Practicing the invention it is possible for a laser printer directly on site at an establishment utilizing the business forms according to the invention to print the appropriate information on the form, then to cut and Z-fold the intermediate form so as to readily produce a pocketed structure. The invention utilizes standard size sheets of paper (e.g., about 8×11 inches) making production on existing equipment simple and easy.

According to one aspect of the present invention, a method of making a pocket containing business from a sheet of paperlike material, having first and second faces, a length, and a width, and at least a first fold line extending widthwise thereof, is provided. The method comprises the following steps: (a) Imaging indicia on the first face of the sheet of paper at a first portion thereof. (b) Cutting the sheet lengthwise to provide two or more sections of essentially the same size. (c) Effecting eccentric folding of each of the sections about the first fold line so as to leave the first portion of the first face uncovered so that the indicia imaged thereon is readily visible. And (d) after step (c), affixing the eccentrically folded section portions together so as to form a pocket opening up toward the first portion, on the first face.

The sheet typically has a second fold line widthwise thereof, and step (c) is practiced to effect eccentric Z-folding of each of the sections about the first and second fold lines. Preferably the sheet has dimensions of about 8×11 inches, and step (b) is practiced to cut the sheet in half, forming two sections each of about 4×11 inches. Step (b) is typically practiced before step (c).

Step (a) is practiced to print due date indicia for a library book on a sheet portion, in the preferred embodiment. Also, there is then the further step of gluing the second face of the sheet to an inside cover portion of a library book, and placing an index card having information about the library book into the pocket.

Pressure activated adhesive strips are preferably provided on the first and second faces of the sheet that will come in contact with each other during Z-folding, prior to step (a), and then step (d) is practiced by applying pressure to the adhesive strips to seal them together.

The invention also comprises a business form intermediate. The intermediate has the following elements: A sheet of paperlike material having first and second faces a rectangular configuration, a length of about 11 inches, a width of about 8 inches, top and bottom edges, side edges, and a centerline intermediate the side edges. A first fold line extending parallel to the top and bottom edges and about 6¼ inches from the top edge. A second fold line extending parallel to the top and bottom edges and about 2⅜ inches from the first fold line and the bottom edge. The first fold line defining a first panel between the top edge and the first fold line, and the second fold line defining a second panel between the first and second fold lines, and a third panel between the second fold line and the bottom edge. Cooperating adhesive patterns disposed on the first face of the first panel adjacent the fold line, and on the first face of the second panel, including adjacent the side edges and the centerline. And cooperating adhesive patterns disposed on the second faces of the second and third panels, including adjacent the side edges and the centerline, and the bottom edge. The cooperating adhesive patterns preferably comprise strips of pressure activated adhesive, and indicia imaged on the first face of the first panel is more than about 2⅜ inches from the first fold line toward the top edge.

The invention also comprises a pocket containing business form. The business form according to the invention comprises a single sheet of paper like material, comprising: A first panel having a first length and a first width, and first and second faces. A second panel having a second length and the first width, the second length being less than one half the first length, and having first and second faces which are continuations of the first and second faces of the first panel. A first fold line between the first and second panels extending widthwise of the panels, the second panel folded about the first fold line so that the first face of the second panel comes into contact with the first face of the first panel, the first panel having a free portion not covered by the second panel. Indicia imaged on said free portion of said first panel. And adhesive connecting said first face of said second panel to said first face of said first panel to form a pocket capable of receiving an index card. The business form also further comprises, in the preferred embodiment, a third panel having a second length and the first width, having first and second faces which are continuations of the first and second faces of the first and second panels. A second fold line is provided between the second and third panels extending widthwise of the panels, the third panel folded about the second fold line so that the second face of the third panel comes into contact with the second face of the second panel; and adhesive connects the second faces of the second and third panels together so that they both cooperate with the first panel to form the pocket.

The indicia which is provided on the free portion of the first panel preferably indicates the due date of a library book, and the pocket containing business form is in combination with a library book with the second face of the second panel affixed to an inside cover portion of the library book with adhesive. While any type of paperlike sheet material may be utilized, a relatively stiff paper material, such as PMS-461 brown stock, is provided.

Each of the panels preferably has longitudinal edges defining the width thereof, and adhesive connecting the first and second panel first faces together comprises cooperating strips of pressure activated adhesive disposed adjacent the longitudinal edges of both the first and second panel first faces. The adhesive for connecting the second and third panel second faces together comprises cooperating strips of pressure activated adhesive disposed adjacent the longitudinal edges of both the second and third panel second faces.

It is a primary object of the present invention to provide a simple yet effective business form which can be used on the inside cover of library books for indicating the due date and for containing an index card. This and other objects of the invention will become clear from an inspection of the detailed description of the invention, and from the appended claims.

BRIEF DESCRIPTION OF THE DRAWINGS

FIG. 1 is a top perspective view of the front face of an exemplary business form intermediate according to the present invention;

FIG. 2 is a top perspective view of the rear face of the exemplary business form intermediate of FIG. 1;

FIG. 3 is a top perspective view of the front face of one section of the intermediate of FIGS. 1 and 2, shown starting to be folded about the first and second fold lines thereof;

FIG. 4 is an upside down perspective view of the front face of the business form, with pocket, formed from the section of FIG. 3;

FIG. 5 is a top perspective view showing the business form of FIG. 4 fastened on the inside cover of a library book and holding an index card in the pocket thereof; ad FIG. 6 is a schematic showing the steps in the practice of an exemplary method according to the present invention for producing what is illustrated in FIG. 5.

DETAILED DESCRIPTION OF THE DRAWINGS

An intermediate for a pocket containing business form according to the present invention is shown generally by reference numeral 10 in FIGS. 1 and 2. The intermediate 10 comprises, preferably, a single sheet of material, preferably paperlike material such as bond paper, light paperboard, card stock, manilla folder stock, or the like. One particularly advantageous paperlike material that may be utilized is PMS-461 brown, which is solid and solid and gives the effect of manilla paper. However, a wide variety of materials may be utilized.

The sheet has a first (front) face 11 (see FIG. 1) and a second (back) face 12 (see FIG. 2). It includes a top edge 13, a bottom edge 14, side edges 15, 16, and a centerline 17 bisecting the edges 13, 14 and parallel to the edges 15, 16. The centerline 17 may just be an ink line, but it may be a perforation, fold line, or another type of line of weakness, or it may merely be an imaginary line. Line 17 merely indicates where a guillotine cut of the intermediate 10 will take place when producing a business form according to the invention.

Preferably the sheet forming the intermediate 10 has a length (the distance between edges 13, 14) of about 11 inches, and a width (the distance between edges 15, 16) of about 8 inches, with the centerline 17 being about 4 inches from either edge 15, 16. Located approximately $6\frac{1}{4}$ inches down from the top edge 13 is a first fold line 18, and located about $2\frac{3}{8}$ inches from the first fold line 18 and a bottom edge 14 is a second fold line 19. The area between the edge 13 and first fold line 18 is the first panel 21, the area between the fold lines 18, 19 is the second panel 22, and the area between the fold line 19 and bottom edge 14 is the third panel 23. Panels 22, 23 have the same length and width. The panel 21 includes a top portion thereof above a line (or imaginary line) 24 which is $2\frac{3}{8}$ inches from the first fold line 18, which—when a business form is formed from the intermediate—is a "free" portion in that it is uncovered by other portions of the sheet and any indicia thereon is readily visible. Indicia—shown generally by reference numeral 26 in FIG. 1—preferably is printed on that portion.

Also on the first face 11 are various adhesive patterns for holding the intermediate 10 panels in a position to which they are folded with respect to each other to form a final business form. The patterns preferably comprise adhesive strips, such as the strips 27, and the panel 21 and the portion thereof between the line 24 and first fold line 18, adjacent the side edges 15, 16, as well as the patterns or strips 28 straddling the center line 17 in the same panel portion. Disposed on the second panel 22 first face 11 are the strips or patterns 29 adjacent the edges 15, 16, as well as the patterns or strips 30 straddling centerline 17. Additional patterns or strips 31, 32, may be provided in the first panel 21 of second panel 22, as illustrated in FIG. 1.

Normally, the back face 12 of the intermediate 10 will not have indicia thereon. However, there will be adhesive patterns in the second and third panels 22, 23. The adhesive patterns typically comprise the strips 33 adjacent the edges 15, 16 and the strips 34 straddling the centerline 17, as well as the strips 35 in the third panel 23 adjacent the edges 15, 16, and the strips 36 straddling the center line 17 in the third panel 23. The patterns of strips 37, 38 are also provided in the second 22 and third 23 panels, respectively, adjacent the fold line 18 and bottom edge 14, respectively.

Note that the strips or patterns 27, 29 align, the strips or patterns 28, 30 align, the strips or patterns 31, 32 align, the strips or patterns 33, 35 align, the strips or patterns 34, 36 align, and the strips or patterns 37, 38 align, when the intermediate 10 is folded as will be hereinafter described, to produce a business form according to the invention.

While the adhesive strips 27 through 38 may be formed of a variety of different adhesives, preferably they are formed of pressure activated adhesive, which is used with Moore Business Forms, Inc. pressure sealing equipment, so that upon application of pressure of about 100 per linear inch or more, the strips are permanently sealed together.

When the intermediate 10 is to be constructed into a business form, after printing the indicia 26 thereon—which preferably is, as illustrated in FIGS. 3 through 5 words 40 and a grid 41 which provide due date information for a library book—the intermediate 10 is then guillotine cut along the centerline 17, to provide two sections, such as the section 42 (which is from the left hand side of the intermediate 10 of FIG. 1) illustrated in FIG. 3. After guillotine cutting, the section 42 is eccentrically Z-folded so that the strips 27, 28 come in contact with the strips 29, 30 and the strips 33, 35 come in contact with the strips 34, 36. Then the construction is fed through automatic pressure sealing equipment, such as available from Moore Business Forms, Inc., and the product that results—the pocketed business form—is shown generally by reference numeral 45 in FIG. 4. Note that the second and third panels 22, 23 form—with the first face 11 of the first panel 21—a pocket 46. The pocket, which is sealed along the longitudinal edges (16, 17), and is also solid at the bottom (14, 18) is dimensioned so that it can receive a $3\times5$ index card 47 therein (see FIG. 5), the index card 47 typically having indicia 48 thereon which corresponds to a library book 49 (see FIG. 5) to which the pocketed business form 45 is affixed. Typically the form 45 is affixed to an inside cover of a library book 49—as illustrated in FIG. 5—by gluing the back face 12 of the form 45 to the inside cover of the book 49.

FIG. 6 schematically illustrates exemplary method steps for practicing the method of making a pocket containing business form from a sheet of paperlike material, according to the invention. The sheet is fed—as indicated by arrow 51—to a laser printer or like simplex printer, which prints the indicia 26 (e.g., due date, indicia for a library book 40, 41) on the first face 11 thereof. Then the sheet, in the form of intermediate 10, is guillotine cut at 53. After that it is passed to an eccentric Z-fold step 54, and from there to a conventional adhesive sealing step 55. The step 55—as described above—preferably is a pressure activating step for applying pressure to the portions of the form overlying the adhesive strips 27, 29, etc., to produce the final business form 45. Then the form 45 is applied to a book as indicated at 56, typically by hand gluing it to the inside cover of a book 49 as illustrated in FIG. 5.

It will thus be seen that according to the present invention a simple and advantageous pocket containing business form is provided according to the present invention, from a simple intermediate, and in a simple inexpensive method that may be practiced directly on the user's site. While the invention has been herein shown and described in what is presently conceived to be the most practical and preferred embodiment, it will be apparent that other modifications may also be practiced within the scope of the invention. For example, if desired, a second cut could be made along the second fold line 19 and then only one eccentric V-fold be made about the first fold line 18 to produce a business form; or a single fold line could be provided located further down along the length of the intermediate 10 so that the pocket 46 formed in the ultimate business form would be deeper. These and other modifications are within the scope of the present invention, which scope is to be accorded the broadest interpretation of the appended claims to encompass all equivalent structures, devices, and methods.

What is claimed is:

1. A pocket containing business form comprising:

a single sheet of paper like material, comprising a first panel having a first length and a first width, and first and second face;

a second panel having a second length and said first width, said second length being less than one half said first length, and having first and second faces which are continuous of the first and second faces of said first panel;

a first fold line between said first and second panels extending widthwise of said panels, said second panel folded about said first fold line so that said first face of said second panel comes into contact with said first face of said first panel, said first panel having a free portion not covered by said second panel;

indicia imaged on said free portion of said first panel;

adhesive connecting said first face of said second panel to said first face of said first panel to form a pocket capable of receiving an index card;

a third panel having said second length and said first width, and having first and second faces which are continuations of the first and second faces of said first and second panels; an second fold line between said second and third panels extending widthwise of said panels, said third panel folded about said second fold line so that said second face of said third panel comes into contact with said second face of said second panel; and adhesive connecting said second faces of said second and third panels together sot hat they both cooperate with said first panel to form said pocket.

2. A pocket containing business form as recited in claim 1 wherein the length of said first, second and third panels combine is approximately eleven inches.

3. A pocket containing business form as recited in claim 2 wherein the width of each of said panels is approximately eleven inches.

4. A pocket containing business form as recited in claim 1 wherein the width of both of said panels is approximately four inches.

5. A pocket containing business form as recited in claim 1 wherein said indicia comprises indicia indicating a due date of a library book.

6. A pocket containing business form as recited in claim 5 in combination with a library book, said second face of said first panel affixed to an inside cover portion of said library book with adhesive.

7. A pocket containing business form as recited in claim 1 wherein said sheet of paperlike material comprises PMS-461 brown stock.

8. A pocket containing business form as recited in claim 1 wherein each of said first and second panels has longitudinal edges defining the width thereof, and wherein said adhesive for connecting said first and second panel first faces together comprises cooperating patterns of pressure activated adhesive disposed adjacent said longitudinal edges of both said first and second panel first faces.

9. A pocket containing business form as recited in claim 1 wherein each of said first panels has longitudinal edges defining the width thereof, and wherein said adhesive for connecting said first and second panel first faces together comprises cooperating patterns of pressure activated adhesive disposed adjacent said longitudinal edges of both said first and second panel first faces, and wherein said adhesive for connecting said second and third panel second faces together comprises cooperating patterns of pressure activated adhesive disposed adjacent said longitudinal edges of both said second and third panel second faces.

10. A pocket containing business form in combination with a library book, having an inside cover portion, comprising:

a single sheet of paper like material, comprising:

a first panel having a first length and a first width, and first and second face;

a second panel having a second length and said first width, said second length being less than one half said first length, and having first and second faces which are continuations of the first and second faces of said first panel;

a first fold line between said first and second panels extending widthwise of said panels, said second panel folded about said first fold line so that said first face of said second panel comes into contract with said first face of said first panel, said first panel having a free portion not covered by said second panel;

indicia imaged on said free portion of said first panel comprising indicia indicating the due date of said library book;

adhesive connecting said first face of said second panel to said first face of said first panel to form a pocket capable of receiving an index card; and adhesive affixing said second face of said first panel to said inside cover portion of said library book.

11. A business form intermediate comprising a sheet of paperlike material having first and second faces a rectangular configuration, a length of about 11 inches, a width of about 8 inches, top and bottom edges, side edges, and a centerline intermediate said side edges;

a first fold line extending parallel to said top and bottom edges and about $6\frac{1}{4}$ inches from said top edge;

a second fold line extending parallel to said top and bottom edges and about $2\frac{3}{8}$ inches from said first fold line and said bottom edge;

said first fold line defining a first panel between said top edge and said first fold line, and said second fold line defining a second panel between said first and second fold lines, and a third panel between said second fold line and said bottom edge;

cooperating adhesive patterns disposed on said first face of said first panel adjacent said fold line, and on said first face of said second panel, including adjacent said side edges and said centerline; and cooperating adhesive patterns disposed on said second faces of said second and third panels, including adjacent said side edges and said centerline, and said bottom edge.

12. An intermediate as recited in claim 11 wherein said cooperating adhesive patterns comprise strips of pressure activated adhesive.

13. An intermediate as recited in claim 11 further comprising indicia imaged on said first face of said first panel more than about $2\frac{3}{8}$ inches from said first fold line toward said top edge.

14. A method of making a pocket containing business form from a sheet of paper like material, having first and second faces, a length, and a width, and at least a first fold line extending widthwise thereof, comprising the steps of:

(a) imaging indicia on the first face of the sheet of paper at a first portion thereof;

(b) cutting the sheet lengthwise to provide two or more sections of essentially the same size;

(c) effecting eccentric folding of each of the sections about the first fold line so as to leave the first portion of the first face uncovered so that the indicia imaged thereon is readily visible; and (d) after step (c), affixing the eccentrically folded section portions together so as to form a pocket opening up toward the first portion, on the first face.

15. A method as recited in claim 14 wherein the sheet has a second fold line extending widthwise thereof, and wherein step (c) is practiced to effect eccentric Z-folding of each of the sections about the first and second fold lines.

16. A method as recited in claim 15 wherein the sheet has dimensions of about $8\times11$ inches, and wherein step (b) is practiced to cut the sheet in half, forming two sections each of about $4\times11$ inches.

17. A method as recited in claim 14 wherein step (b) is practiced before step (c).

18. A method as recited in claim 14 wherein step (a) is practiced to print due date indicia for a library book on the sheet first portion.

19. A method as recited in claim 18 comprising the further step of gluing the second face of the sheet to an inside cover portion of a library book.

20. A method as recited in claim 19 comprising the further step of placing an index card having information about the library book into the pocket.

21. A method as recited in claim 14 wherein pressure activated adhesive strips are provided on the first face of the sheet prior to step (a); and wherein step (d) is practiced by applying pressure to the adhesive strips to seal them together.

22. A method as recited in claim 15 wherein pressure activated adhesive strips are provided on the first and second faces of the sheet that will come in contact with each other during Z-folding, prior to step (a); and wherein step (d) is practiced by applying pressure to the adhesive strips to seal them together.

23. A method as recited in claim 16 wherein the sheet has a top edge defining the first portion thereof, and wherein step (c) is practiced to fold about the first fold line about $6\frac{1}{4}$ inches from the top edge, and to fold about the second fold line about $2\frac{3}{8}$ inches from the first fold line.

* * * * *